US007657201B2

(12) United States Patent
Haga

(10) Patent No.: US 7,657,201 B2
(45) Date of Patent: Feb. 2, 2010

(54) IMAGE FORMING APPARATUS, IMAGE FORMING METHOD AND CONTROL PROGRAM OF THE SAME

(75) Inventor: Tatsuyoshi Haga, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 568 days.

(21) Appl. No.: 11/453,210

(22) Filed: Jun. 14, 2006

(65) Prior Publication Data

US 2007/0047995 A1 Mar. 1, 2007

(30) Foreign Application Priority Data

Aug. 24, 2005 (JP) ..... 2005-242761

(51) Int. Cl.
*G03G 15/00* (2006.01)

(52) U.S. Cl. ..... 399/81

(58) Field of Classification Search ..... 399/81
See application file for complete search history.

(56) References Cited

U.S. PATENT DOCUMENTS 5,543,897 A * 8/1996 Altrieth, III ..... 399/81

FOREIGN PATENT DOCUMENTS

JP 05204523 A * 8/1993
JP 8-293954 A 11/1996

* cited by examiner

*Primary Examiner*—David M Gray
*Assistant Examiner*—Bryan P Ready
(74) *Attorney, Agent, or Firm*—Frishauf, Holtz, Goodman & Chick, P.C.

(57) ABSTRACT

Disclosed is an image forming apparatus including: a dedicated operation input section having various function keys provided with the image forming apparatus; a connection section to connect an external operation input section having various keys with the image forming apparatus; a memory section to memorize a correspondence information table for each user, in which relationship between the various function keys of the dedicated operation input section and the various keys of the external operation input section is specified; and a control section to control an image forming operation by referring to the correspondence information table for each user memorized in the memory section when an operation input signal is inputted into the control section through the connection section from any of the various keys of the external operation input section.

10 Claims, 12 Drawing Sheets

FIG. 5 (a)

USER SETTING INFORMATION DISPLAY SCREEN

| Hard Key / User | [ Start ] | [ Stop ] | [ Reset ] | ・・・ |
|---|---|---|---|---|
| Default | Enter | Esc | BackSpace | |
| User A | F1 | F2 | F3 | |
| User B | Alt | Fn | Tab | |
| User C | Home | End | CAPS | |
| ⋮ | | | | |

FIG. 5 (b)

| Hard Key / User | [ Start ] | [ Stop ] | [ Reset ] | ・・・ |
|---|---|---|---|---|
| Default | Enter | Esc | BackSpace | |
| User A | F4 | F2 | F3 | |
| User B | Alt | Fn | Tab | |
| User C | Home | End | CAPS | |
| ⋮ | | | | |

FIG. 9

USER SETTING INFORMATION TABLE

| | |
|---|---|
| Default | TEN-KEY: NUMERIC KEY<br>UP/DOWN CURSOR: START/STOP<br>F1: HELP<br>F2: APPLICATION FUNCTION 1<br>F3: APPLICATION FUNCTION 2 |
| user A | TEN-KEY: NUMERIC KEY<br>UP/DOWN CURSOR: HISTORY BACK/FORWARD<br>F1: HELP<br>F2: APPLICATION FUNCTION 1<br>F3: APPLICATION FUNCTION 2 |
| user B | TEN-KEY: APPLICATION FUNCTION 1, 2, 3<br>UP/DOWN CURSOR: START/STOP<br>F1: CLEAR<br>F2: RESET<br>F3: POWER SAVE |
| user C | TEN-KEY: NUMERIC KEY<br>UP/DOWN CURSOR: HISTORY BACK/FORWARD<br>F1: HELP<br>F2: APPLICATION FUNCTION 5<br>F3: APPLICATION FUNCTION 4 |
| user D | TEN-KEY: NUMERIC KEY<br>UP/DOWN CURSOR: HISTORY BACK/FORWARD<br>F1: A4 SELECTION + STAPLE + 4 SETS + START COPY<br>F2: A3 SELECTION + DUPLEX + 2 in 1 + 10 SETS<br>F3: APPLICATION FUNCTION 1 + 5 SETS + START COPY |
| | ⋮ |

FIG. 11 user A

| OPERATION NUMBER | OPERATION CONTENT |
|---|---|
| 1 | START COPY |
| 2 | DUPLEX SELECTION |
| . . . . . | |
| 100 | STOP |

user B

| OPERATION NUMBER | OPERATION CONTENT |
|---|---|
| 1 | DUPLEX SELECTION |
| 2 | STAPLE |
| . . . . . | |
| 100 | STOP |

IMAGE FORMING APPARATUS, IMAGE FORMING METHOD AND CONTROL PROGRAM OF THE SAME

CROSS REFERENCE TO RELATED APPLICATION

The present application is based on Japanese Patent Application No. 2005-242761 filed with Japan Patent Office on Aug. 24, 2005, the entire content of which is hereby incorporated by reference.

BACKGROUND OF THE INVENTION

1. Field of the Invention

The present invention relates to an image forming apparatus, an image forming method and a control program of the same, which allocate operational buttons to external keys.

2. Description of Prior Art

In recent years, as office automation and home automation progress, the efficiency of social activities also progresses. Particularly, a network system for improving the efficiency by connecting a plurality of personal computers (PCs) with the network system is utilized in various areas of fields. For example, developed in a company has been a system having a network onto which a plurality of personal computes and a copier are connected for printing documents and image data produced by the personal computers and/or for reading data stored in a floppy disk (registered trade-name) and printing them by the copier.

Further, Unexamined Japanese Patent Application Publication No. H8-293954 discloses a copier capable of utilizing the copier as not only a copier but also a personal computer. According to the Japanese Patent Application described above, since the keyboard of the personal computer can not only operate the copier but also the copier can be used as a personal computer, it becomes possible to reduce the cost comparing with the cost when separately buying the copier and the personal computer. Further, by allocating the each key of the operational panel of the copier to each key of the keyboard of the personal computer, it becomes possible to operate the copier from the keyboard of the personal computer.

However, when trying to execute the same operation by connecting a keyboard with the conventional copier into which a copier and a person computer are combined, since each key of the keyboard is not allocated to each key of the copier, there is a case that the operation cannot be executed. Further, in recent year, it is common that plural people share one copier. Meanwhile, copiers having various functions based on the recent progress of technologies have been developed. Consequently, since the using method and functions of one copier are different for each user, it is necessary to improve the operability of each user.

Further, when using the copier, there are many cases that plural operations are required. Since as the technologies of copier progress, the operations of the copier have become complicated, there is another problem that it takes time to setup the printing conditions.

An object of the present invention to improve the operability of a user with a keyboard as an external operation input device which is connected to an image forming apparatus, when plural users share one image forming apparatus. Another object of the present invention is to change the plural operations into easy operations. Another object here is to improve the handling of the copier by allowing the user to be able to retrace back to the operation, which the user has operated.

SUMMARY

In accordance with one aspect of the present invention, an image forming apparatus comprises: a dedicated operation input section having various function keys provided with the image forming apparatus; a connection section to connect an external operation input section having various keys with the image forming apparatus; a memory section to memorize a correspondence information table for each user, in which relationship between the various function keys of the dedicated operation input section and the various keys of the external operation input section is specified; and a control section to control an image forming operation by referring to the correspondence information table for each user memorized in the memory section when an operation input signal is inputted into the control section through the connection section from any of the various keys of the external operation input section.

In accordance with another aspect of the present invention, an image forming apparatus comprises: a dedicated operation input section having various function keys provided with the image forming apparatus; a connection section to connect an external operation input section having various keys with the image forming apparatus; a multiple operations memory section to memorize multiple operations inputted by the dedicated operation input section by correlating with any key of the various function keys of the external operation input section; and a control section for executing control corresponding to the multiple operations stored in the multiple operations memory section when an operation input signal is inputted through the connection section into the control section from the key correlated with the multiple operations.

In accordance with another aspect of the present invention, an image forming apparatus comprises: a dedicated operation input section having various function keys, provided with the image forming apparatus; a connection section to connect an external operation input section having various keys with the image forming apparatus; a memory section to memorize a correspondence information table, in which relationship is specified between the various function keys of the dedicated operation input section and the various keys of the external operation input section; a control section to control an image forming operation by referring to the correspondence information table memorized in the memory section when an operation input signal is inputted into the control section through the connection section from any of the various keys of the external operation input section; and an operation history memory section to memorize a history of operations inputted by the dedicated operation input section or by the external operation input section.

BRIEF DESCRIPTION OF THE DRAWINGS

These and other objects, advantages and features of the invention will become apparent from the following description thereof taken in conjunction with the accompanying drawings in which:

FIGS. 5(*a*) and 5(*b*) illustrate an example of a user setting information display screen memorized in the memory section of the copier of the embodiment;

FIG. 9 illustrates an example of the user setting information table memorized in the memory section of the variation of the copier;

FIG. 11 illustrates an example of an operation history table memorized for each user in the variation of the copier.

DETAILED DESCRIPTION OF THE PREFERRED EMBODIMENTS

Figure 1:
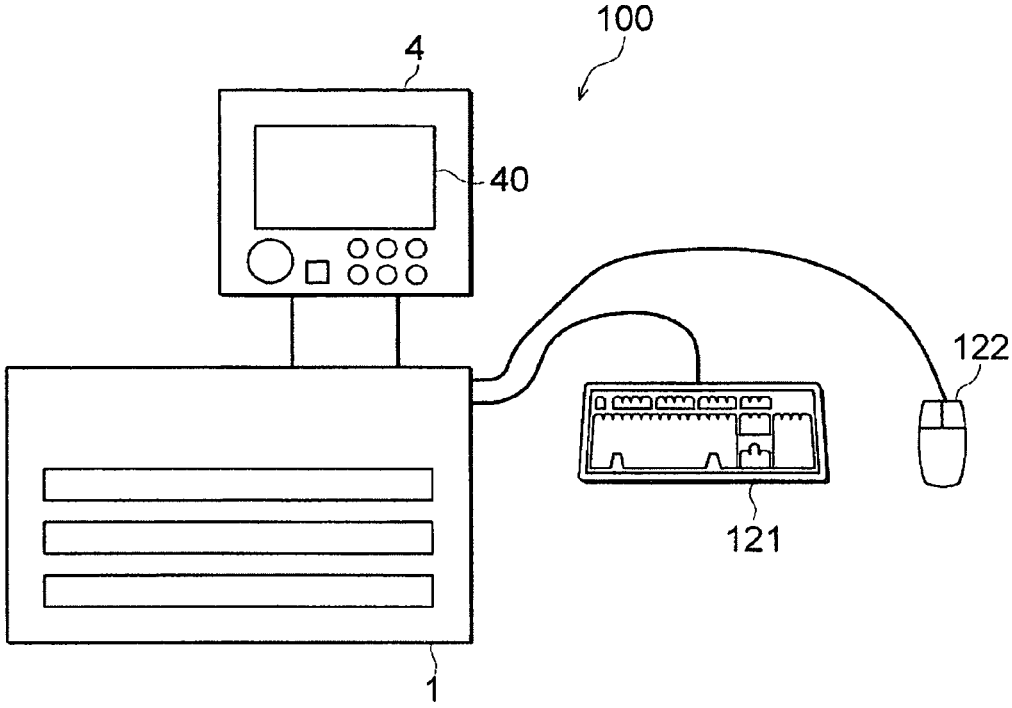
FIG. 1 illustrates a schematic diagram of a copier of the present embodiment.

An embodiment of the present invention will be described in detail by referring to the drawings below.

FIG. 1 illustrates a schematic diagram of an image forming apparatus 100 (hereinafter it will be called a copier) of the present embodiment. As shown in FIG. 1, the copier 100 comprises a main body 1, an operation display section 4, a keyboard 121 as an external operation input device and a mouse 122. The operation display section 4 includes a display screen 40 (it will be described later).

The copier 100 has a configuration having a USB host device controller in a controller board so that external input devices such as a USB mouse and/or USB keyboard can be freely hooked up and removed from the controller board. A CPU controls a USB device and the same CPU controls the copier. Comparing with the case controlling the copier through network, this configuration makes it possible to execute input process in a higher speed.

The user uses copier 100 by confirming an instruction and image data displayed on the operation display 4, and operating the keyboard 121 or the mouse 122. Since the operation display section 4 includes various function keys such as a hard key 42 as an annex input device (it will be described later), it is possible for the user to directly operate these keys.

Further, the keyboard to be connected with the copier 100, as the external operation input device is preferably a keyboard compatible with a 101-key keyboard having 101 keys therein or a 106-key keyboard having 106 keys therein.

Figure 2:
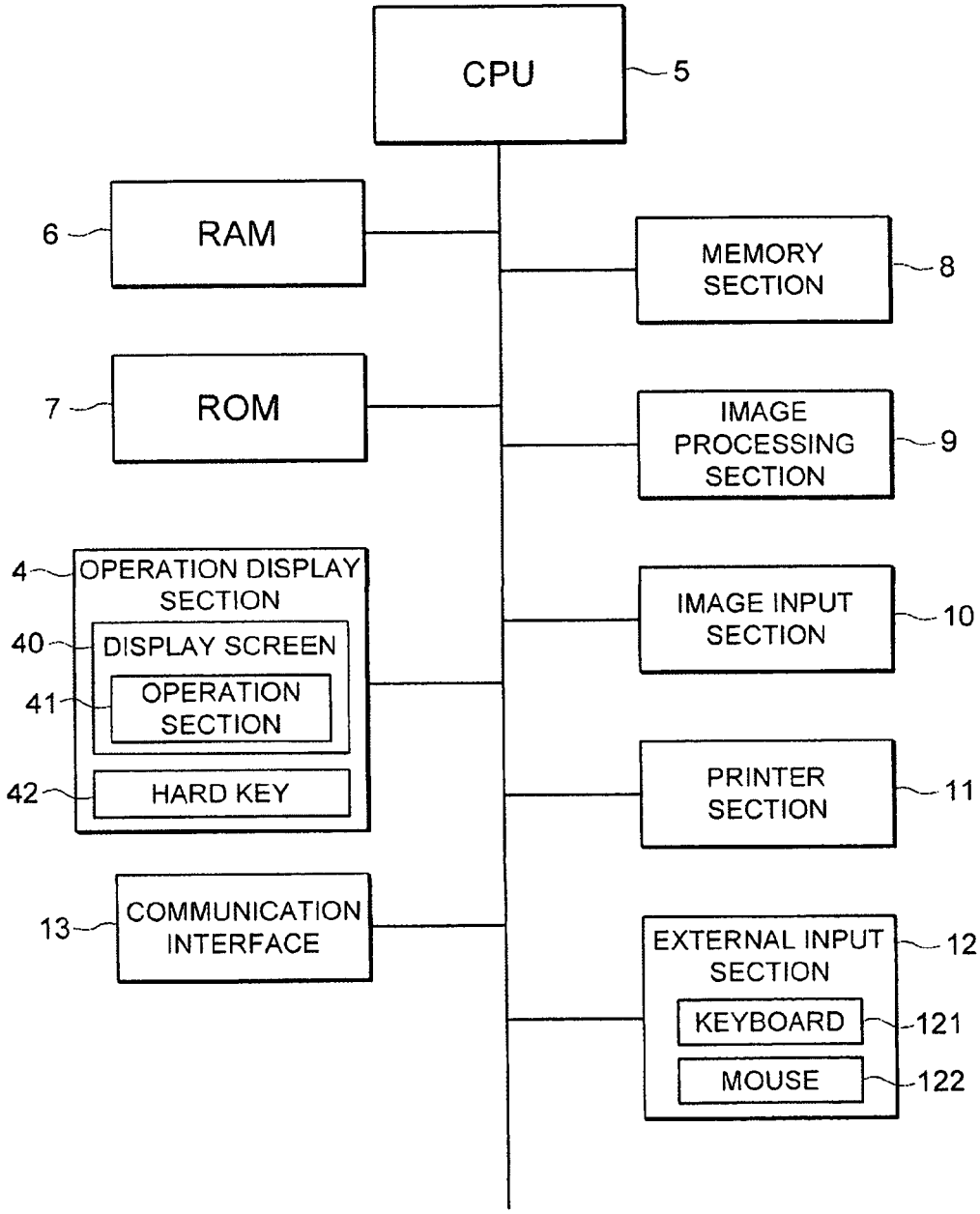
FIG. 2 illustrates the main diagram of the copier shown in FIG. 1.

FIG. 2 illustrates the main diagram of the copier shown in FIG. 1. As shown in FIG. 2, the copier 100 comprises a CPU (Central Processing Unit) 5, a RAM (Random Access Memory) 6, a ROM (Read Only Memory) 7, the operation display 4, the memory section 8, an image processing section 8, an image input section 10, a printer section 11, an external input section 12 and a communication interface 13.

The CPU 5 executes processes based on a predetermined program according to the inputted instruction, and is a central processing unit for giving instructions and transferring data to each functional section. Concretely, the CPU 5 reads out a program stored in the ROM 7 in response to the operation signals inputted from the operation display section 4 and executes processes according to the program. Then the CPU 5 displays the processed results onto the display screen 40 of the operation display section 4.

The CPU 5 executes various programs extended in a program storing area of the RAM 6. The data of processed results generated when executing various programs are temporarily stored in a work area of the RAM 6.

The ROM 7 stores programs, which are necessary to operate the copier 100 and the data associated with the execution of the program. These programs are programs, which do not need to be rewritten or which should not be rewritten. When the user presses down a key of the keyboard 121, a press-down signal is transmitted to the CPU 5. The CPU 5 reads out a keyboard conversion table (it will be described in detail later) from the memory section 8 and specifies the pressed key from key cords, which include the received press-down signal. Then CPU 5 converts the key codes according to the program stored in the ROM 7, and decides the key of the copier 100 in response to the converted key code. Once the CPU 5 has decided the key, then the CPU 5 executes the same operation as when receiving the press-down signal of the key.

Hereinafter, the allocation of a hard key 42 of the copier 100 to the keyboard 121 will be described. However, the allocation to the keyboard 121 is not limited to the hard key 42. It is possible to allocate other keys of the copier 100.

The operation display section 4 is configured by LCD (Liquid Crystal Display) etc. The operation display section 4 further includes a display screen 40 for displaying various screens such as a mode selection screen by which a user conducts the mode selection in the copier 100 and setting screens for inputting the copier functions according to the display signal inputted from CPU 5, and an operation section 41 for outputting detected position signals to the CPU 5 as operation signals by detecting the XY-coordinates of the point on the screen where force is applied by a finger by using a pressure sensing touch panel (resist film-pressure method). The display screen 40 displays operation buttons for inputting operation instructions in the various screens. The operation section 41 detects the coordinates information pressed by a finger and outputs the position information to the CPU 5 as operation signals. The CPU 5 detects input of the operation instruction in response to the pressed operation button.

Further, the operation display section 4, apart from the operation section 41 formed on the display screen 40 described above, includes a hard key 24 such as a ten-key as an annex operation input device, a clear key, a menu key and a Start key and outputs the operation signals by key operations to the CPU 5.

An image input section 10 comprises a scanner provided under contact glass, onto which a document is placed, the scanner reading out the image on the document. The scanner includes a light source and a CCD (Charge Coupled Device). The scanner reads out the image on the document by forming images based on the reflected light beams, which have been irradiated from the light source to the document and conducting photoelectric conversion of the image. The scanner further conducts A/D conversion with the read image to obtain digital image data and outputs them to a image processing section 9.

When the image input section 10 inputs the digital image data to an image processing section 9, the image processing section 9 applies a space filter processing, magnification/reduction processing, a rotation processing and a gradation correction processing, which are image processing to the digital image data and outputs them to the printer section 11.

A printer section 11 (not shown) comprises a photoreceptor drum, a laser source, a pulse width modulator, a charger, a developer, a paper sheet feeder section, a paper sheet ejecting section and a fixing section. When the image processing section 9 inputs image data to the printer section 11, the printer section radiates laser beams by modifying the pulse width by the pulse width modulator and forms an electrostatic latent image by irradiating the laser beams onto the surface of the photoreceptor drum which has been charged by the charger. Then, the printer section 11 conveys a printing paper sheet, the size and the direction of which are specified through the operation display section 4 or inputted by the external input section 12, fixes toner onto the area including electrostatic latent image on the surface of the photoreceptive drum by the developer, transfers toner onto the printing paper sheet which has been conveyed, fixes the toner image onto the printing paper sheet and ejects the printing paper sheet from the printing section.

The keyboard 121 and the mouse 122 are connected with the external input section 12. The user confirms the instructions and/or image data displayed on the display screen 40. For example, when applying image processing to the image data, the user executes processing by operating the keyboard 121 or the mouse 122. Still, the hard key 42 and a touch panel of the operation display section 4 may be used for executing the process.

A communication interface 13 is an interface for connecting the copier 100 with communication network, the communication interface 13 conducting the control of the communication with a remote operation apparatus through the communication network. For example, when printing the image to which a personal computer has applied the image processing, the data are transmitted through the communication interface 13.

The memory section 8 includes a non-volatile recording medium such as HDD (Hard Disk Drive) and memorizes print image data, a keyboard conversion table as a corresponding information table, user setting information and operation history. The recording medium may be configured by a magnetic medium, optical recording medium or semiconductor memory, which is freely attached and detached to the copier. With regard to the keyboard conversion table, user setting information and operation history will be described later.

Figure 3:
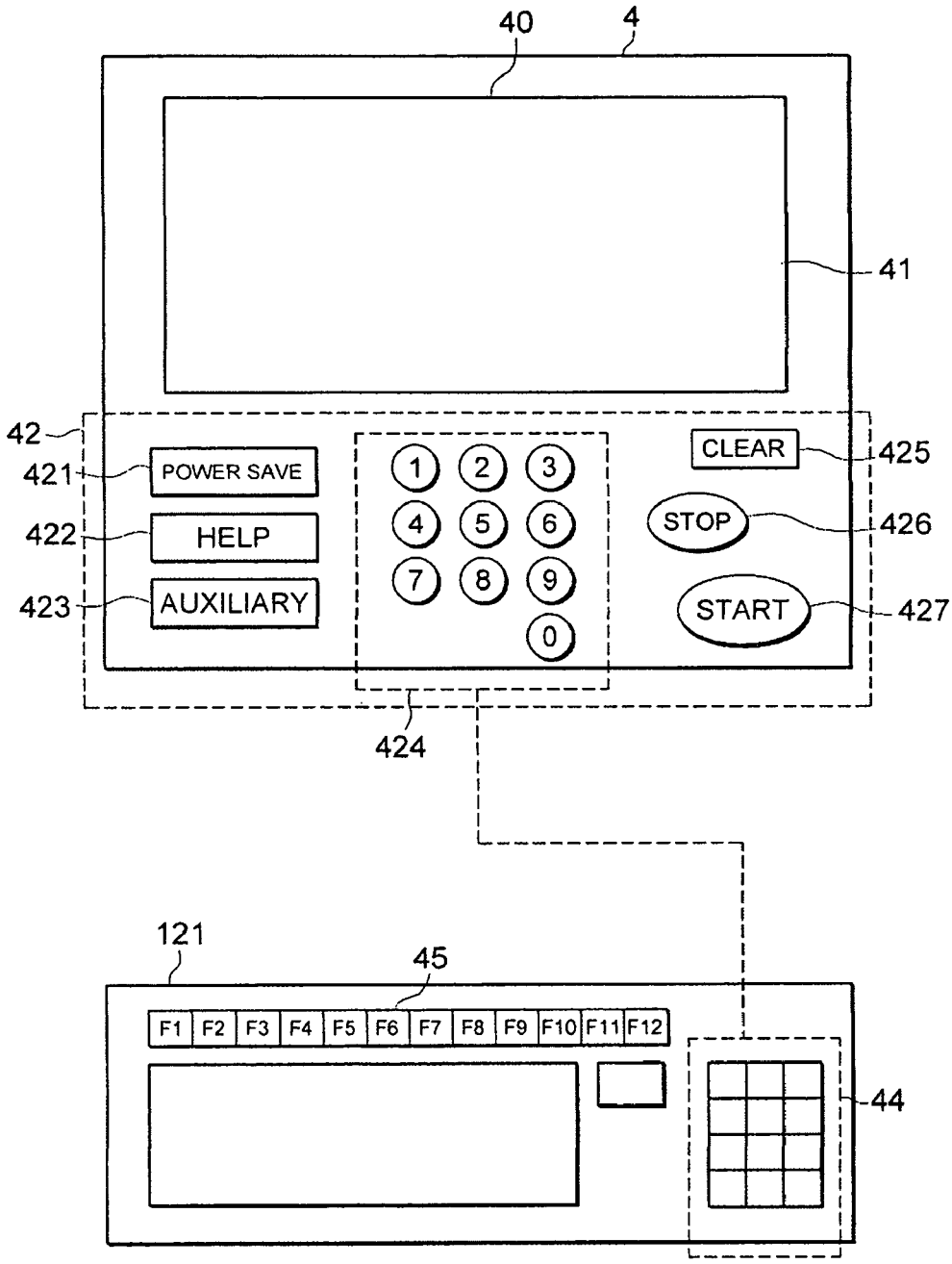
FIG. 3 illustrates an example of the schematic block diagram of an operation display section and a keyboard.

Next, FIG. 3 illustrates an example of schematic diagram of the operation display section 4 and the keyboard 121. As shown in FIG. 3, the operation display section 4 of the copier 100 includes a hard key 42 such as a power save key 421, a help key 422, an auxiliary key 423, numeric keys 424, a clear key 425, a Stop key 426 and a Start key 427.

The help key 422 is a pressing key when the user cannot understand the operation of the copier 100, and the operation display section 4 displays an operation guide of the copier 100 when the help key 100 is pressed. The numeral keys 42 are used to input a user number and the number of printing paper sheets, etc. When the numeral keys 42 input the user number, which has been set in advance, the CPU 5 in the copier 100 reads out the user information corresponding to the received input signal from a plurality of user information memorized in the memory section 8 and displays the user information of the user on the operation display section 4. The clear key 425 is a key for clearing input information, which is used when inputting wrong printing paper sheet number or when returning to a default setting condition from a printing setup contents condition which has been set up previously. The Stop key 426 is a key for stopping printing operation. The Start key 427 is a key for indicating the start of printing. The Start key 427 is also used for determining the input information.

The user confirms various instructions and image data displayed on the display screen 40 and executes the process by pushing necessary hard key 42. The numeral key 424 of the operation display section 4 corresponds to the ten-key 44 in the keyboard 121 connected to the external input section 12. Accordingly, for example, when inputting the number of printing paper sheets, it may be inputted from the numeral key 424 of the hard key 42 or inputted from the ten key 44 of the keyboard 121 to execute the same processing. The function key 45 is allocated to any one of the hard keys 42 by the user. There is a key, which the user cannot allocate in the function key 45. (This will be described later.)

Since an operation section 41 is provided in the display screen 40 of the operation display section 4, it is also possible to conduct operation by directly pushing various buttons displayed on the display screen 40 (touch panel). Accordingly, when starting or finishing the process, the user may press a Start key 427, a Stop key 426 or the operation section 41 of the display screen 40 to execute the process.

Here, other than the various keys described above, the function of each key of the copier 100 will be described. It includes not only the hard key 42 but also keys on the touch panel. Other than the various keys described above, the copier 100 includes an interruption key, a confirmation copy key, a utility key, a counter key and a setting contents key.

The interruption key instructs interruption while operating a copy operation. For example, the interruption key is used when inserting another job in the long job. The confirmation copy key is used for confirming the printing quality by outputting a printing paper sheet. The utility key is a key for shifting to a maintenance mode under which obtaining the control information and adjusting the apparatus. The counter key is a key to display the outputted counter information. The setting content key is a key for confirming the output setting contents such as the paper sheet size and the number of output paper sheets.

The operation display section 4 of the copier 100 is fixed onto the main body 1 as shown in FIG. 1. However, it is not limited to this. Due to the preference of the user, there is a case that it is hard for a user to use the operation display section 4 depending on the position where the operation display section 4 is fixed. In the case of this situation, the user can execute the process by using the keyboard 121 or the mouse 122 connected with the external input section 12 of the copier 100. In this case, the numeric key 424 corresponds to the ten key 44 of the keyboard 121, however it is necessary to correspond other keys such as the Stop key 426 and the Start key 427 to the each key of the keyboard 121. Consequently, the memory section 8 of the copier 100 memorizes the keyboard conversion table to correspond these hard keys 42 to the each key of the keyboard 121.

Figure 4:
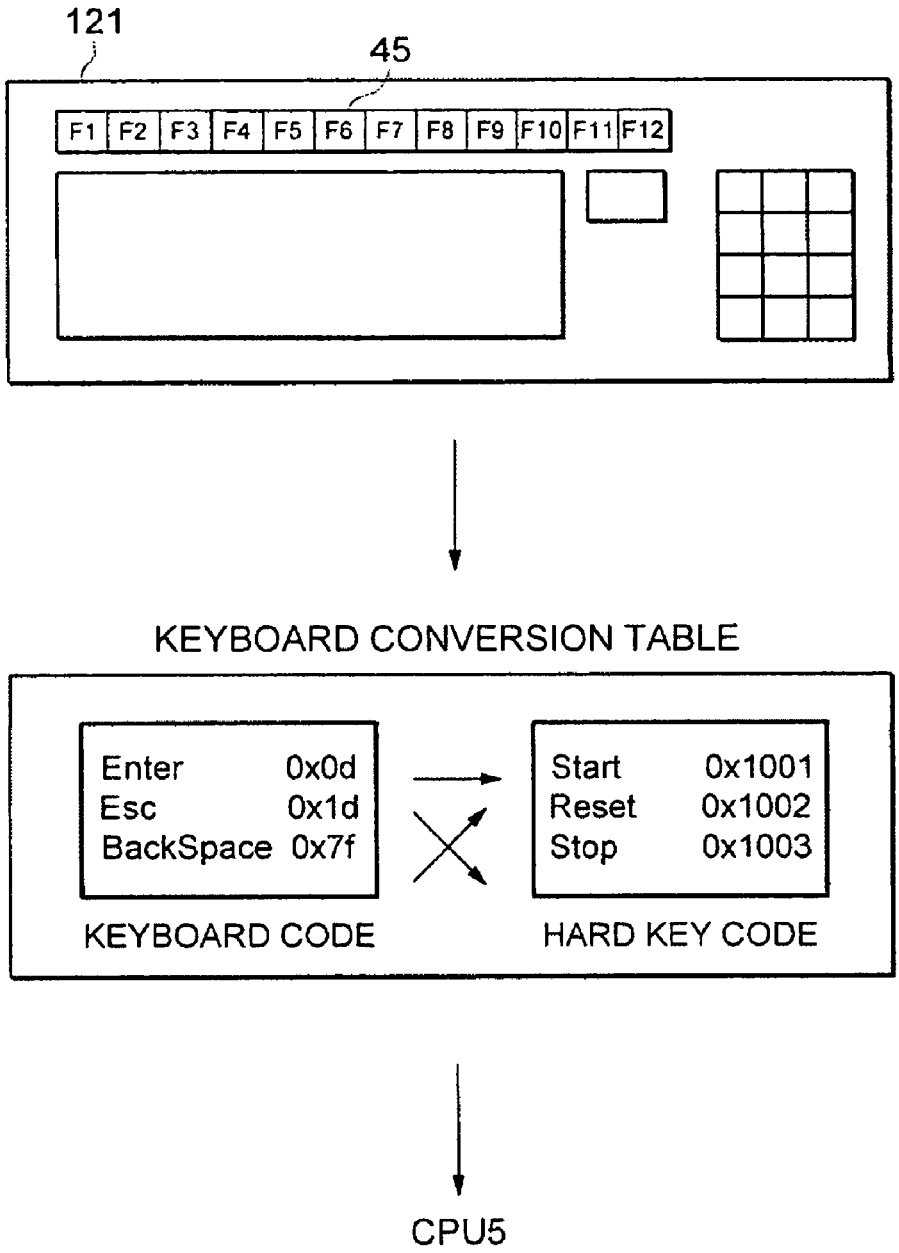
FIG. 4 illustrates an example of a keyboard conversion table.

FIG. 4 illustrates an example of a keyboard conversion table. As shown in FIG. 4, the hard keys 42 described above and various function keys of the keyboard key 121 respectively have key codes. The CPU 5 can reflect the operation from the keyboard 121 to the process executed by the operation of the hard key 42 corresponding to the key of the keyboard 121 by converting the key code, which the various function keys hold, to the key code to be corresponded based on a keyboard conversion table. Concretely, when the Start key 427 of the hard key 42 of the copier 100 is allocated to the Enter key of the keyboard 121, if the user presses the Enter key of the keyboard 121, the pressing signals is transmitted to the CPU 5. Based on the pressing signals, the CPU 5 reads out the key code of the Enter key pressed by the user and converts the key code to the key code of the Start key 427 based on the keyboard conversion table. Then, based on the converted key code, the CPU 5 determines that the Start key of the hard key 42 has been pressed and executes the process supposed to be executed when the pressing signals are received.

Further as shown in FIG. 4, when the Stop key 426 of the hard key 42 is allocated to the Esc key of the keyboard 121 and when the Reset key 425 of hard key 42 is allocated to the Back Space key of the keyboard 121 are the same as described above. When a key in the keyboard 121 is pressed, CPU 5 receives the pressing signals, reads out the key code based on the key coke conversion table then converts the key code to the allocated key code of the hard key 42. Then the CPU 5 determines which key of the hard key 42 is pressed based on the converted key code and controls the operation of each section based on the key.

The allocation of the hard key 42 to each key of the keyboard 121 based on the keyboard conversion table described above is set and stored per each user. The user can freely change these settings. Accordingly, it is not limited to the allocation shown in FIG. 4. The user can allocate the hard key 42 of the copier 100 to each key of the keyboard 121, which the user can easily handle. The memory section 8 memorizes a plurality of the keyboard conversion tables, which is set up per a user. Then the CPU 5 displays the setting information per a user onto the operation display section 4 as user setting information. Further, the user can change the own setting by referring to the user setting information display screen (refer to FIG. 5).

The keyboard 121 is configured so that the hard key 42 of the copier 100 is allocated to the keyboard 121. The configuration will be described below. However, it is not limited to the hard key 42. For example, the operation section 41 of the operation display section may be allocated to the keyboard 121.

As shown in FIG. 4, the keyboard 121 includes a plurality of function keys 45 (F1-F12). It is possible to allocate each key to any key of the hard key 42 of the copier. However, with reared to F9-F12, the allocation per user is prohibited but a common function for everybody is allocated to the F9-F12. With regard to the common function, for example, the common function may be a function for changing user settings. This function can be achieved by allocating a user setting-switching key, for example, a key F9. It becomes possible that any user can use F9 as a user setting-switching key and switch the user name and read out the own settings.

Meanwhile, the keys, which the allocations per user are prohibited, (common keys) are function keys F9-F12. Hereinafter, setting of these keys will be described, but not limited to function keys F9-F12. It is possible to allocate F1-F4 and F3-F5 as common operation keys.

As described above, it becomes possible to avoid confusion by allocating the specific operation, the operation which are common to all users, to common keys among the keys in the keyboard 121, by not freely allocating all keys. It becomes possible to improve the work efficiency of the user by allocating the common operation to common keys in advance, since the user does not need to allocate the operation to a specific key.

Next, FIG. 5(*a*), (*b*) show one example of the user setting information displayed on the display screen 40 when setting the keyboard conversion table per a user. FIG. 5(*a*) shows the situation before updated. FIG. 5(*b*) shows the user setting information display screen after update.

When completing the allocation setting to the keyboard 121 per the plural users based on the process described above, the display screen displays the user setting information screen as shown in FIGS. 5(*a*) and 5(*b*). As shown in FIG. 5(*a*), it is possible to check that which key of the keyboard 121 is allocated to which function key of the hard key 42 associated with the user in the user setting information screen. Accordingly, it is possible to change the setting based on the user setting information of others when the operability is bad. For example, in the case of situation shown in FIG. 5(*a*), the user A has allocated the F1 keys of the keyboard 121 to the Start key 427 of the hard key 42. However, when changing the setting from F1 to F4 due to the bad operability, the user setting information displayed on the user setting information display screen is updated as shown in FIG. 5(*b*), every time when the user setting information is updated. Accordingly, the user setting information screen displayed on the operation display 4 is always updated information.

When the user setting information display screen is displayed, the user presses the user setting-switching operation key described above (for example F9). When receiving the pressing signals from the user, the CPU 5 executes the control for switching the setting of the keyboard 121 to the user setting, which is specified by the pressing signals.

Figure 6:
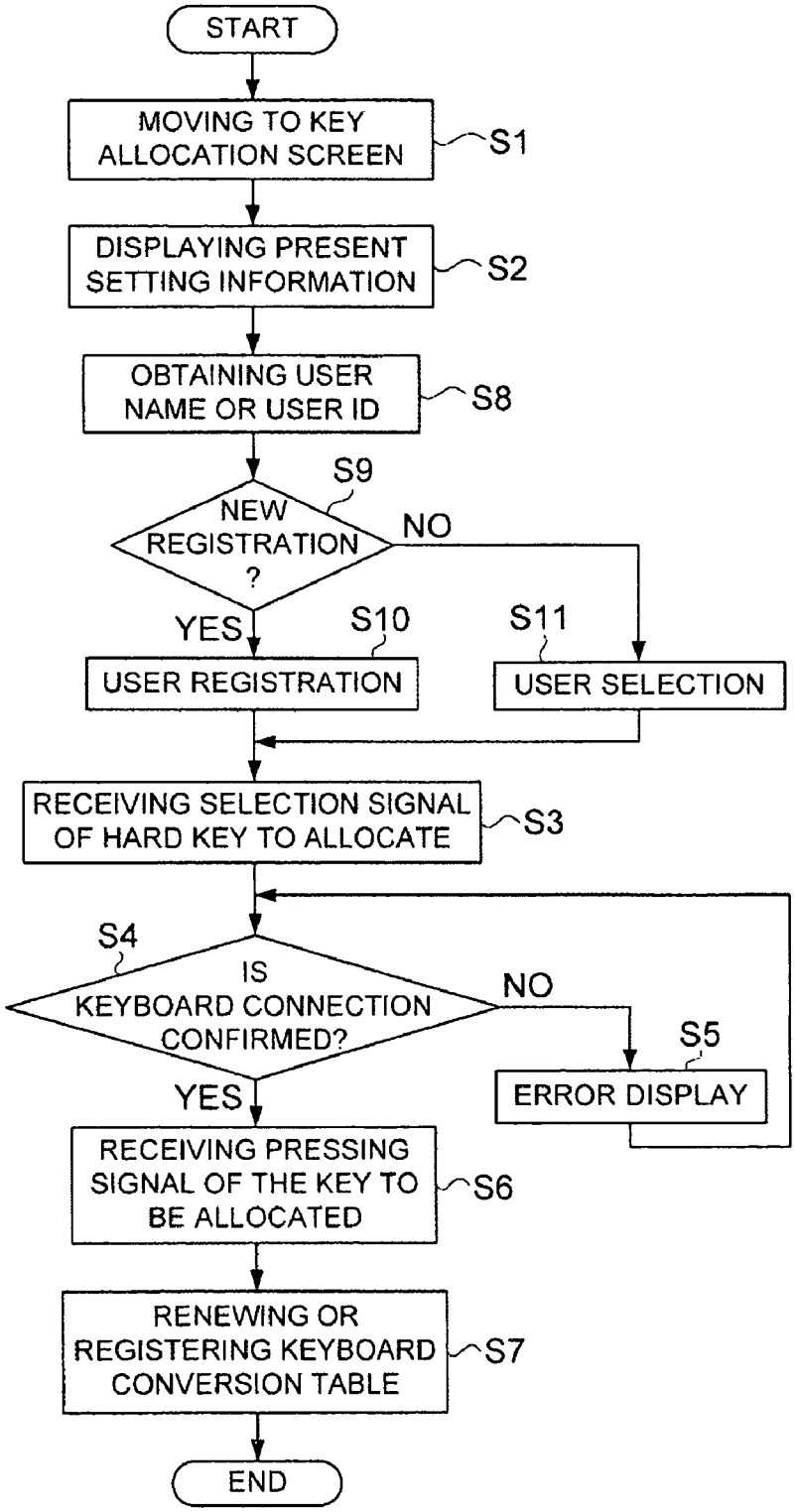
FIG. 6 illustrates a flowchart showing processes executed when setting the keyboard conversion table.

Next, the setting method of the keyboard conversion table will be described by referring to FIG. 6. Namely, the method of the allocation to the keyboard 121 will be described below.

Firstly, the CPU 5 reads out the key allocation screen by operating the hard key 42 of the copier 100 or the operation section 41 of the display screen 40 (step S1). On the step S1, when reading out the key allocation screen, current setting information will be displayed (step S2). By displaying the current setting information, it becomes possible for the user to check the keys, which have been already allocated, and to avoid to allocate the same key of the hard key 42 to two keys of the keyboard 121. Further, it is possible for the user to check the key in the keyboard 121, which has been already allocated, at the same time, to check the keys, which are prohibited to allocate, such as common setting keys F9-F12.

When the current setting information is displayed in the step S2, a user name or a user ID can be obtained (step S8) by the operation of the user from the operation section 4. Here, the system is arranged to input the user name or the user IC. However, it is not limited to this configuration. For example, when the user information has already registered, since the information is displayed on the screen, the user name or the user ID may be selected by pressing the user setting-switching key (for example F9). In step S8, when obtaining the user name or the user ID by the user input operation, the CPU 5 determines whether the setting for allocating the key for the obtained user name or user ID is new registration or not (step S9).

In step S9, if the CPU 5 determines that the key allocation setting of the obtained user name or the user ID is new registration, (step S9; YES), then the user name or the user ID is registered (step S10).

In step S9, if the CPU 5 determines that key allocation setting of the obtained user name or the user ID is not new registration (step S9; NO), then, the user is selected based on the obtained user name or user ID (step S11) and the keyboard conversion table of the selected user is read out.

When the user reads out the keyboard conversion table of the user by selecting the user based on the registration of the user name in step S10, or the selection of the user based on the user name or user ID at step S11, the user checks the displayed screen and selects the key by pressing the hard key 42, which the user wants to allocate on the keyboard. With regard to the method of allocation, it may be possible by pressing the hard key 42 to be allocated or by displaying various keys of the hard key 42 on the display screen 40 and selecting the key by using the mouse 122. When the hard key 42 to be allocated by the user, the CPU 5 is arranged to receive the selection signals (step S3).

In the step S3, when the CPU 5 of the copier 100 receives the inputted signals from the user, the CPU 5 checks if the keyboard 121 is connected to the copier 100 (step S4). In the step S4, if the CPU 5 determines that the keyboard is not connected with the copier 100 (step S4; NO), then the CPU 5 displays the error message on the operation display section 4 (step S5) to notify the user that the keyboard 121 is not connected. When the user checks this message, the user connects the keyboard 121 with the copier 100. On the step 5, when the error message is displayed, then the CPU 5 repeats the determination of the step 4.

In the step S4, the CPU 5 determines that the keyboard 121 is connected with the copier 100 (step S4; YES), the display screen 40 displays that the keyboard 121 is connected with the copier 100. When the user checks the display screen, the user presses the key of the keyboard 121 to be allocated to the hard key 42. When the user presses the key of the keyboard 121 to be allocated, the CPU 5 receives the pressing signals (step S6).

In the step S6, when the CPU 5 receives the pressing signals of the key in the keyboard 121 to be allocated to the hard key 42, if the user setting is not new registration, the CPU 5 updates the keyboard conversion table stored in the memory section 8 (step S7). Meanwhile, when it is new registration, the keyboard conversion table is registered as a new user (step S7). According to this update or registration, the hard key 42 is allocated to the pressed key of the keyboard 121. And at the same time, the user setting information display screen is also updated and registered.

Figure 7:
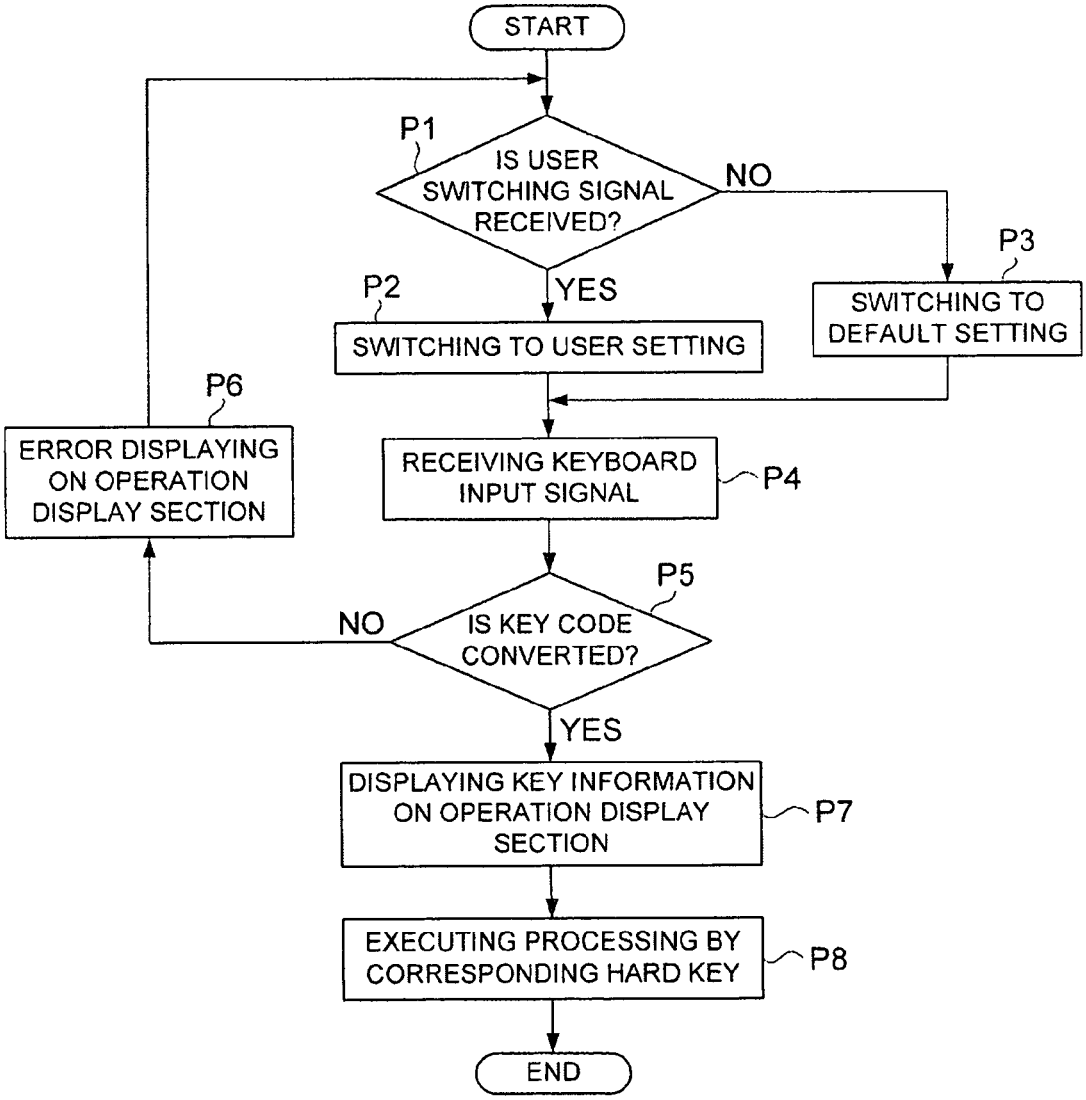
FIG. 7 illustrates a flowchart showing processes executed based on the instruction inputted from the keyboard.

Next, the process executed based on the instruction inputted from the keyboard 121 will be described by referring to the flowchart shown in FIG. 7.

Firstly, the CPU 5 determines whether the CPU 5 has received a user switching signals with regard to the keyboard setting based on the user operation (step P1). In the step P1, when the CPU 5 determines that the CPU 5 has received the user switching signals (step P1; YES), the CPU 5 executes the operation for switching to the user setting in response to the inputted singles (step P2). Namely, the CPU 5 selects the table among the keyboard conversion tables corresponding to the input user. When the CPU 5 determines that the CPU 5 has not received the user switching signals (step P1; NO), the CPU 5 executes the control for switching to the default setting, which has been set in advance (step P3).

When, the CPU 5 switches the user settings corresponding to the input signals in the step P2, or executes the control for switching to the default setting, which has been set in advance in the step P3, and further the CPU 5 receives the keyboard input signals generated by pressing the key of the keyboard 121 by the user (step P4), the CPU 5 determines whether the CPU 5 has converted the key code based on the selected keyboard conversion table (step P5). In the step P5, the CPU determines that the CPU has not converted the key code (step P5; NO), the CPU 5 displays the error message on the operation display section 4 to notify that the key code has not been converted, namely there is no hard key corresponding to the pressed key (step P6).

When the CPU 5 displays the error message on the operation display section 4 in the step P6, the CPU 5 returns the process back to the step P1 and stands by for receiving the keyboard input signals. When, receiving new keyboard input signals, the CPU 5 repeats the processes of steps P1-P5.

When the CPU 5 determines that the key code has been converted in the step 5 (step 5; YES), the CPU displays the key information corresponding to the converted key code on the operation display section 4 (step P7), and executes the same process as the hard key corresponding to the converted key code (step P8).

In the step P7, the CPU 5 may automatically execute the same process by corresponding hard key after displaying the key information, or may be arranged to start processing, for example, by pressing down an OK key.

As described above, by allocating the function key of the copier 100 to any one of the keys of the keyboard 121, it becomes possible to operate the copier 100 even from the keyboard 121. Accordingly, the user can not only operate the copier 100 while sitting of the chair but also can operate the keyboard 121, for example, even when the operation display section 4 is fixed on the upper portion of the copier 100, and the hard key 42 or the touch panel are located in the place where it is hard to handle. Further, the allocation to the keyboard 121 is set and stored per a user and the user can freely change the settings. Consequently, since each user can set the allocation based on the best place for the own operability, the degree of freedom can be enhanced.

Further, since correlation between the function key and the key in the keyboard is easily done by pressing down the key to be correlated, even a user who is not good at operating machines can easily do this setting.

Further, since it is possible to check the own setting but also the setting of the others, it becomes possible to improve the operability by referring to the other settings. Accordingly, it becomes possible to swiftly precede the work.

Variation of the Embodiment

Next, the variation of the embodiment of the copier 100 will be described. Since the schematic diagram of the variation of the copier 100 is the same as FIG. 1 and the main configuration is the same as FIG. 2, the illustration and the explanation will be omitted.

In the embodiment described above, each function key of the copier 100 is allocated any one of key in the keyboard 121, and the user can set the allocation. Further, the copier 100 is configured so that the copier 100 memorizes the setting per each user. In the variation of the embodiment, the copier 100 is configured so that a series of multiple operations conducted by the operation section 41 and the hard key 42 of the copier 100 is allocated to a key of the keyboard 121. The series of multiple operations is preferably an operation, which is frequently used, the operation concretely being the plural selections of the output format, such as selecting paper sheet, sorting, binding in the middle and stapling. Other than the operation being frequently used, the multiple operations include complicated plural operations and plural operations, such as a series of setting for the print used in general. For example, when there are many cases that that duplex printing on A4 sized paper sheet are conducted, by allocate the setting to any one of function keys of the keyboard 121 as a shortcut key, a simple operation can be attained. The memory section 8 of the copier 100 memorizes the setting information corresponding to the key code. The CPU 5 executes a series of operation by reading out the setting information corresponding to the key code of the pressed key of the keyboard 121 when receiving the key pressing signals based on the operation by the key, which is allocated as a shortcut key of the keyboard 121.

Still, this shortcut key can be set per user in the same manner as the key allocation being conducted in the embodiment (refer to FIG. 9). Accordingly, in this case, the memory section 8 memorizes the shortcut key of each user.

Figure 8:
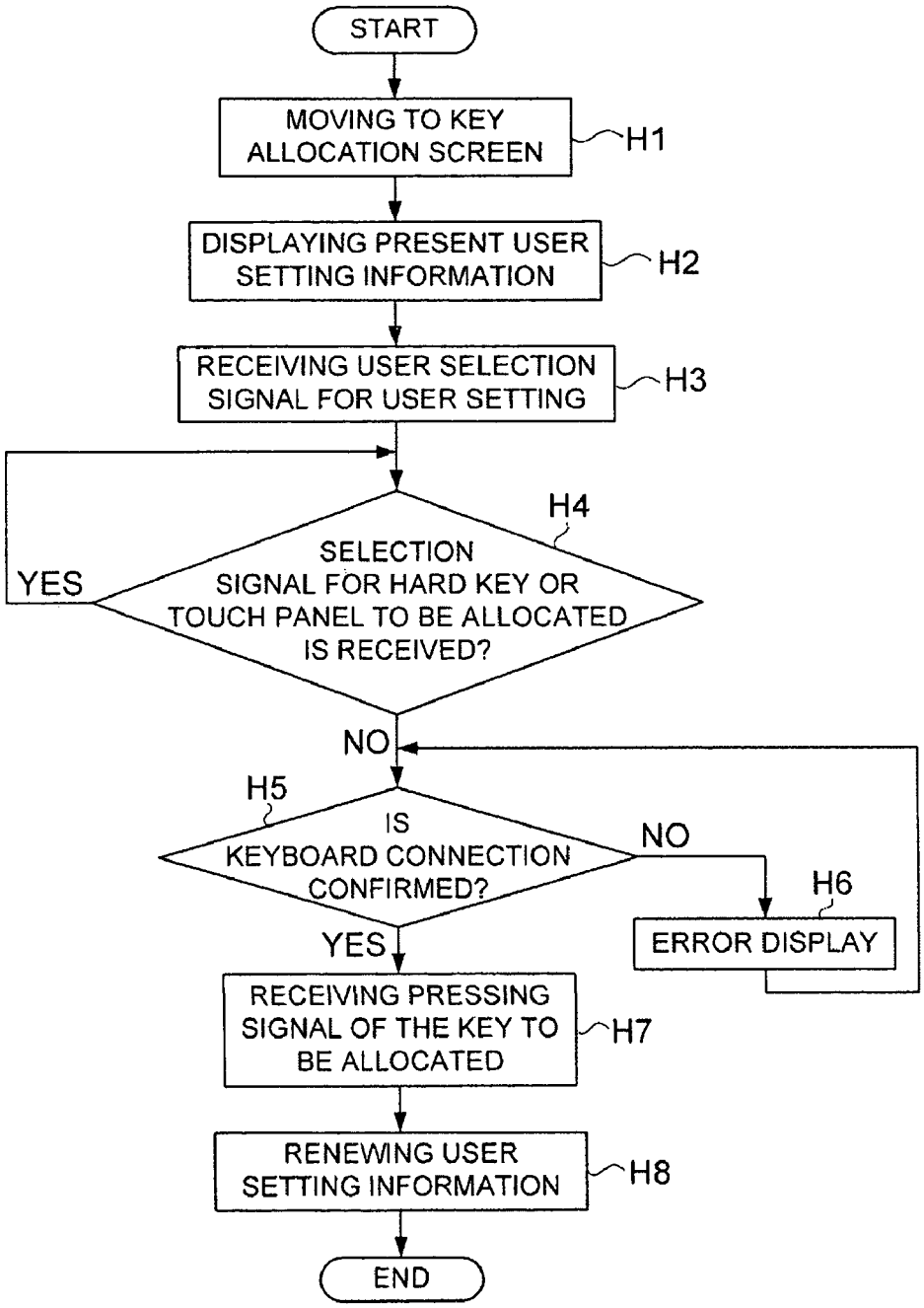
FIG. 8 illustrates a flowchart showing processes executed by a variation of the copier of the embodiment.

The process described above will be explained by referring to FIG. 8.

Firstly, when the CPU 5 receives the instruction for allocating the key based on the operation of the hard key 42 or operation key 41 of the operation section 40 in the copier 100, the CPU 5 reads out the key allocation screen (step H1). In the step H1, the CPU 5 displays the user setting information display screen onto the operation display 4 (step H2). Since the user setting information display screen is the same as the FIG. 5, it will be omitted here. In the step H2, when the current setting information for each user is displayed, the user can check the default setting and avoid setting the same setting as the default setting. Further, it becomes possible not only to check own setting but also to conduct setting by referring to other setting information.

In the step H2, the CPU 5 displaying the current user setting information receives the selection signals when the user selects the user name (step H3). In this case, if the user has already registered, the user selects own setting information. If the user has not been registered, new setting is required and the user newly registers the user name.

Based on the user operation, when the CPU 5 receives the user selection information (step H3), the CPU 5 reads out the user setting information memorized by the memory section 8 based on the selection signals. Then the user selects the hard key 42 or the touch panel to be allocated, and determines whether the CPU 5 is receiving the selection signals (step H4). In the step H4, when the CPU 5 determines that the user has selected the hard key 42 or the touch panel and the CPU 5 is receiving the selection signals, namely, determines that the CPU 5 is receiving the selection signals of other keys (step H4; YES), the CPU 5 repeats the process of step H4. In the step H4, if the CPU 5 determines that the user has selected the hard key 42 or the touch panel but the CPU 5 is not in the situation where the CPU 5 is not receiving the selection signals, namely, the allocation has been completed (step H4; NO), the CPU 5 whether the keyboard 121 is connected with the copier 100 (step H5). The selection of the hard key 42 to be allocated by the user may be conducted by pressing the hard key 42, or conducted by pointing out through the operation panel 41 or the mouse 122 based on the screen displayed on the operation display section 4. The selection of the touch panel to be allocated may be conducted the same way. Still, in the step H4, when the CPU 5 determines that the judgment is YES, plural hard keys, or plural keys of the touch panel are arranged to be allocated to a key of the keyboard 121.

In the step H5, when the CPU 5 cannot identifies the keyboard 121 and determines that the keyboard 121 is not connected with the copier 100 (step H5; NO), the CPU 5 displays the error message on the operation display section 4, and notifies the user the keyboard is not connected with the copier (step H6). The user checks the display, and then connects the keyboard 121 with the copier 100. In the step H6, the CPU 5 displays the error message and repeats the determination of step H5 again.

In the step H5, when the CPU 5 identified the keyboard 121, namely, the CPU 5 determines the keyboard 121 has connected with the copier 100 (step H5; YES), then the user presses the key of the keyboard 121 to be allocated to the hard key 43 or touch panel and the CPU 5 receives the pressing signals (step H7).

In the step 7, when the CPU 5 receives the pressing signals, the CPU 5 updates the user setting information based on the pressing signals (step H8) and completes the process.

Next, an example of the user setting information table stored in the memory section 8 will be shown in FIG. 9.

As shown in FIG. 9, the default setting has been set in the memory section 8 in advance. In the default setting, the numeral key 424 of the hard key 42 is allocated to the ten key 44 in the keyboard 121. Further, the Start key 427 and the Stop key 426 of the hard key 42 are allocated to the up and down keys of the keyboard 121, even though they are not illustrated in the figure. The same as above, the help key 422 of the hard key 42 is allocated to the function key, hereinafter F1 of the keyboard 121. Application function 1 and application function 2 denote the series of operations described in the embodiment above. These are respectively allocated to F2 key and F3 key of the keyboard 121. In the default setting described above, when the operability is bad, the user freely changes the setting.

FIG. 9 illustrates the user settings of a user A, a user B, a user C and a user D. For example, the user B has set an application function to the ten key 44 of the keyboard 121. The user C has set the operation for tracing back on the history or to going forward to the up and down keys of the keyboard 121. The user D has set the operations of a series of operations by plural keys to a key of the keyboard 121. And the combination of keys for the paper sheet selection, the number of paper sheets for printing and setting the after treatment condition is allocated to F1. As described above, a user can freely set the key of the keyboard 121.

Figure 10:
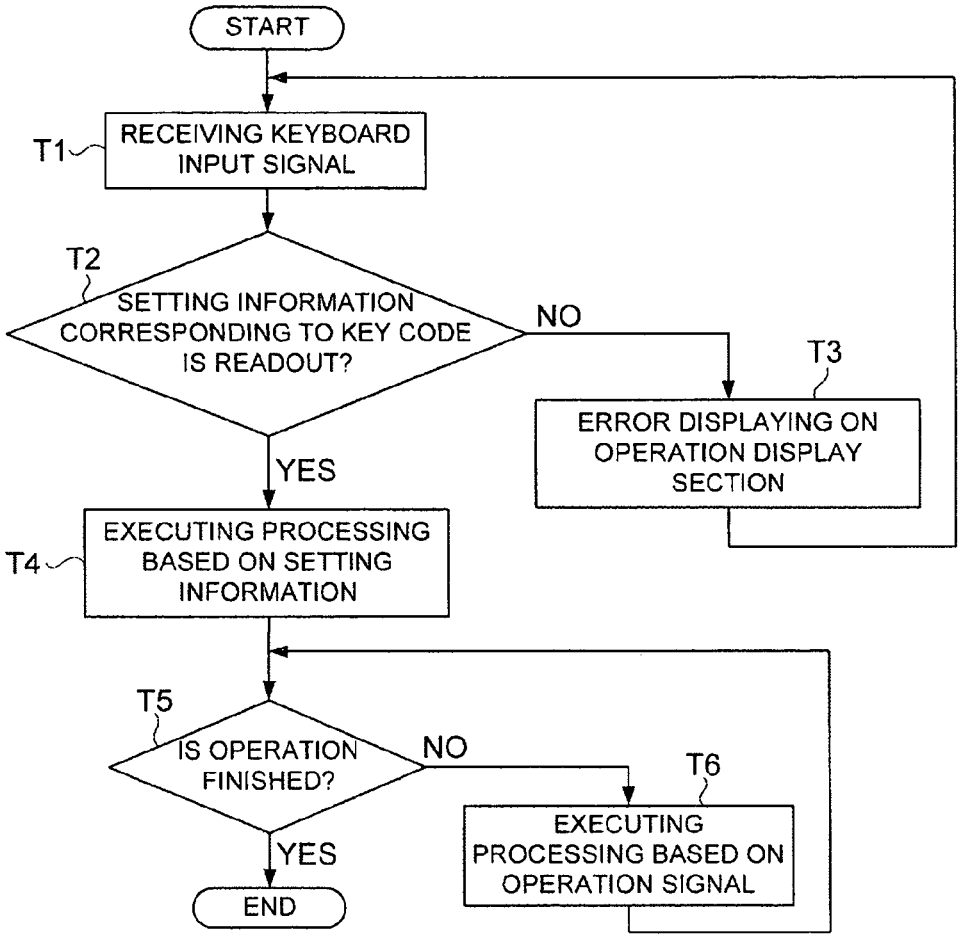
FIG. 10 illustrates a flowchart showing processes executed by the variation of the copier.

The process executed by the shortcut key will be described by referring to the flowchart illustrated in FIG. 10.

The CPU 5 receives the keyboard input signals (step T1) when a user presses the key of the keyboard 121 and determines whether the setting information corresponding to the key coke of the pressed key can be read out (step T2).

When the CPU 5 determines that setting information corresponding to the key code of the pressed key has not been read out (step T2; NO), the CPU 5 displays the error message onto the operation display section 4. Then the CPU 5 notifies the user that the setting information corresponding to the pressed key cannot be read, namely, the setting information has not been set with the pressed key (step T3).

In the step T3, when the CPU 5 displays the error message on the operation display section 4 (step T3), the CPU 5 stands by for receiving the keyboard input signal again at the step T1. And when the CPU 5 receives new keyboard input signals, the CPU 5 repeats the processes in the steps T1-T2 again.

In the step T2, when the CPU 5 determines that there is setting information corresponding to the key code of the pressed key (step T2; YES), the CPU 5 executes the process based on the setting information stored in the memory section 8 (step T4).

In the step T4, when the CPU 5 executes the process based on the setting information corresponding to the pressed key, and determines whether the operation by the keyboard 121 has been completed (step T5).

In the step T5, the CPU determines that the operation by the keyboard 121 has not finished, namely, the next operation signals have been inputted (step T5; NO), and the CPU 5 executes the process based on the inputted operation signals. In this case, the inputted operation signals may be signals generated by pressing the keyboard 121 or the operation signals of the hard key 42 of the copier 100. For example, when any one of key of the keyboard 121 is pressed, the CPU 5 may convert the key code corresponding to the key or executes the process of the hard key 42 corresponding to the key. When pressing any one of the keys of the keyboard 121, the CPU 5 may read out the other setting information.

When the CPU 5 determines that the operation has finished in the step T5 (step T5; YES), the CPU 5 finishes the process. For example, when the user D presses the function Key F1 of the keyboard 121, the same effect can be obtained by pressing the hard key 42 or touch pane of the copier 100 to select A4 sized paper sheet, to select staple, to set four paper sheets for printing and to press the copy start button.

According to the embodiments described above, it becomes possible to correlate the plurality of operations, such as, paper sheet selection, the selection of the paper sheet direction and duplex printing setting with any key of the external operation input device or the combination of the keys and memorize them in advance. And when operating the copier, by operating the key or the combination of the keys, it becomes possible to execute the plurality of the operations. Further, it becomes possible for the user to allow the copier to execute complicated controls and to operate the copier in a short time operation by a simple operation.

Further, since the plurality of the operations can be set per a user, the operability reflecting the user's intention can be improved. It also becomes possible to change the setting to the setting having better operability while referring to the other settings.

Further, the CPU 5 memorizes the history of a series of operations in the memory section 8 by pressing the key of the keyboard 121, and sets the key capable of tracing back the history and forwarding the process (for example, up an down keys of user A in FIG. 9). In concrete, set the maximum value which can be memorized in the memory section 8 in advance, memorize the plural keys of the keyboard 121 in the order of operation conducted and eliminate the memory in the order of older memory when the operation history reaches to the maximum value. Then, allocate the operation for tracing back to the history or forwarding the process to a key or a combination of keys of the keyboard 121. When operating plural operations, for example, when tracing back to previous process, the key of the keyboard 121, which the user has allocated the operation, is pressed. The CPU 5 executes the operation to trace back to the previous process while receiving the pressing signals. Still, it is preferable that the operation history is memorized per a user.

Next, an operation history table memorized per a user will be illustrated in FIG. 11. In FIG. 11 illustrates the operation history table of the user A and the user B, however, it is possible to memorize a plurality of users, not limited to this example. As shown in FIG. 11, the memory section 8 memorizes operation numbers 1-100. Still, the maximum operation number, which can be memorized, is not limited to 100. The user A memorizes "copy start" to the operation number 1, "duplex printing selection" for operation number 2 and "stop" to the operation number 100. Accordingly, when sending a command for trace back to the previous operation in the state of operation number 2, "copy start" of the operation number 1 is executed. Since the user B is the same, the explanation will be omitted.

Figure 12:
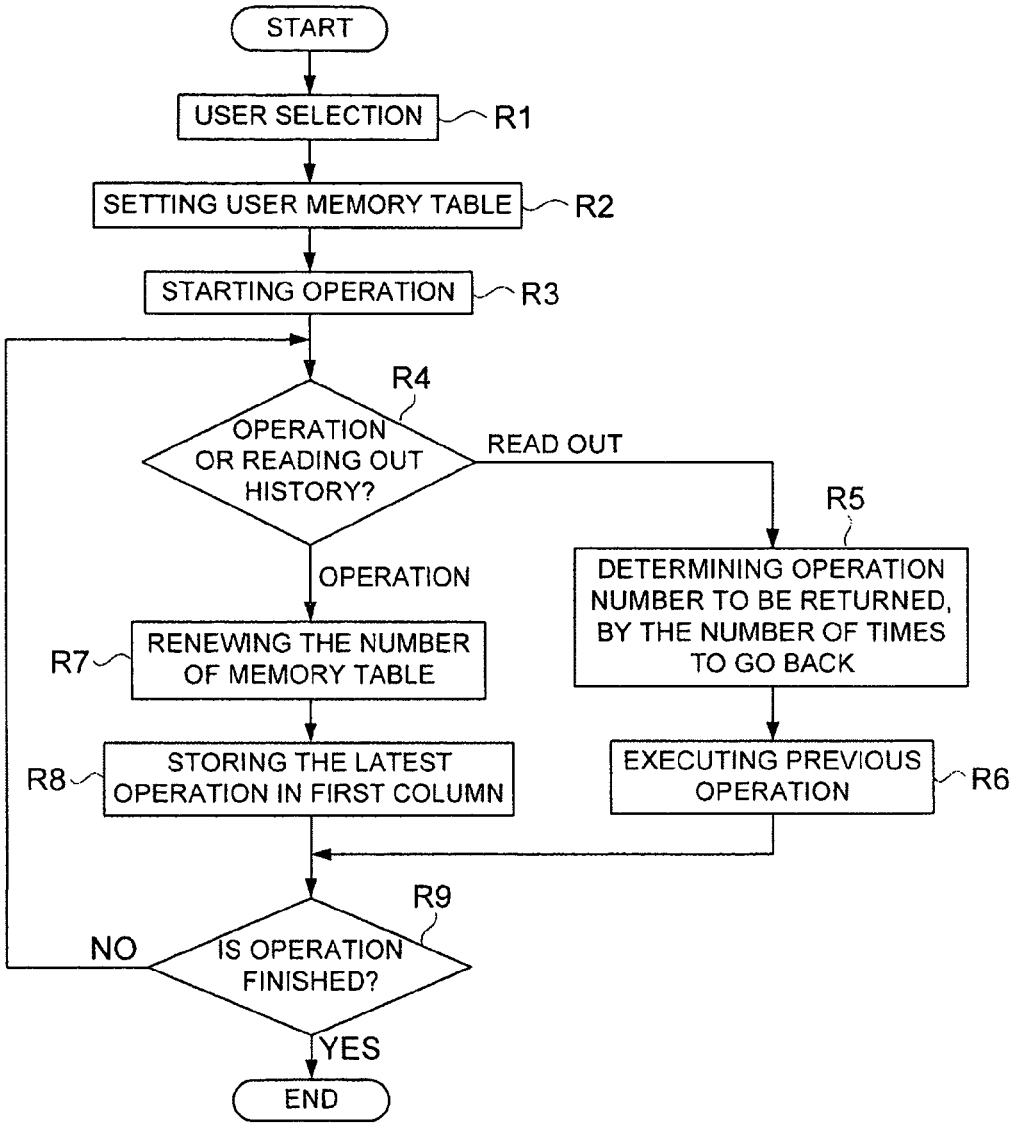
FIG. 12 illustrates a flowchart showing processes for reading out the operation history executed in the variation of the copier.

Next, the operation history read out process will be described by using the flowchart shown in FIG. 12.

Firstly, when the user is selected and the CPU 5 receives the selection signals (step R1), the CPU 5 sets the operation history table of the user corresponding to the signals (step R2). In the step R2, when the CPU 5 sets the operation history table of the user corresponding to the selection signal, the CPU 5 stands by until the CPU 5 receives the operation-start signals.

Then, when receiving the operation-start signals, the CPU 5 determines whether the signals are related to a general operation or the instruction signals for reading out the operation history (step R4). In the step R4, when the CPU 5 determined that the received signal is the instruction signal for reading out the history (step R4; history reading out), the CPU 5 determines the operation number to which the operation is traced back based on the number of times of pressing the key. For example, when pressing the key for executing the process for tracing back the history twice, then the CPU 5 executes the operation stored in operation number 2. Namely, it is possible to trace back the history and execute the process by pressing the number corresponding to the operation number stored in the memory section 8.

In the step R4, when the CPU 5 determines the operation to be traced back based on the pressing number, the CPU 5 executes the past operation memorized in the operation number (step R6).

Meanwhile, in the step R4, when the CPU 5 determines that the received signals are the signals for general operations (step R4; operation), the CPU 5 updates the number of the memory table (step S7). Namely, the operation here becomes the latest operation. Consequently, in the step R7, when the CPU 5 updates the number of the memory table, the CPU 5 stores the latest operation in the operation number 1 (step R8).

In the step R8, when the CPU 5 stores the latest operation into the area of the operation number one, or in the step R6 when the CPU 5 executes the past operation, the CPU 5 determines whether the operation has finished (step R9). In the step 9, when the CPU 5 determines that the operation has not finished yet (step R9; NO), the CPU 5 returns the operation to step R4 and determines again whether the received signals are related to the normal operation or are related to the instruction for reading out the history. In the step R9, when the CPU 5 determines that the operation has finished (step R9; YES), then the CPU 5 finishes the process of the operation history.

As described above, it becomes possible to execute a series of processes only by the operation of the keyboard 121 by memorizing the series of operations conducted against the copier 100 by adding a key code onto the setting information and setting the key code by correlating the key code with the key code base on each key or the combination of the keys of the keyboard 121. Consequently, since, it becomes possible to execute a series of operations, for example, selecting duplex printing and selecting printing paper sheet, at once, and to eliminate the labor and realize the improvement of the work efficiency.

Further, when the user made a mistake on an operation, it becomes possible to clear only the operation on which the user has made the mistake by storing plural operation-histories of each operation as an operation history, and tracing back the process step by step. Accordingly, different from the case where all operation-settings have been deleted, since the operation can be released step by step, it becomes possible to smoothly proceed with the work and minimize the work time.

What is claimed is:

1. An image forming apparatus comprising:

a dedicated operation input section having various function keys;

a connection section to connect an external operation input section having various keys with the image forming apparatus;

a memory section to memorize a plurality of correspondence information tables, wherein each of the plurality of correspondence information tables specifies, for a corresponding user among a plurality of users, relationships between the various function keys of the dedicated operation input section and the various keys of the external operation input section; and a control section to control an image forming operation by selecting one of the correspondence information tables based on a user switching signal from the external operation input section, and by referring to the selected correspondence information table for the corresponding user, when an operation input signal is inputted into the control section through the connection section from any of the various keys of the external operation input section.

2. The image forming apparatus of claim 1, wherein respective key codes are associated with each of the various function keys of the dedicated operation input section and each of the various keys of the external operation input section, and the memory section memorizes the correspondence information table for each of the plurality of users in which relationships between the various function keys and the various keys associated with the respective key codes are specified.

3. The image forming apparatus of claim 1, wherein when any of the various function keys of the dedicated operation input section is pressed to generate a first pressing signal, the control section designates a pressed function key in the various function keys based on the first pressing signal, and wherein when the control section receives a second pressing signal from any of the various keys in the external operation input section just after designation of the pressed function key, the correspondence information table is established to associate a key corresponding to the second pressing signal among the various keys with the pressed function key.

4. The image forming apparatus of claim 1, wherein the various function keys are hard keys.

5. The image forming apparatus of claim 1, wherein each of the correspondence information tables is arbitrarily established by a corresponding one of the plurality of users.

6. The image forming apparatus of claim 1, wherein the external operation input section comprises a keyboard which is compatible with at least one of a 101-key keyboard and a 106-key keyboard.

7. The image forming apparatus of claim 1, further comprising a user information inputting section to input user specifying information, wherein the control section refers to the correspondence information table for the corresponding user based on the user specifying information, and controls the image forming operation according to the user specifying information.

8. An image forming method comprising:

inputting user specifying information;

selecting, based on the user specifying information, one of a plurality of correspondence information tables, wherein each of the plurality of correspondence information tables has been memorized in advance and specifies, for a corresponding user among a plurality of users, relationships between various function keys of a dedicated operation input section of an image forming apparatus and various keys of an external operation input section; and controlling, by using the various keys of the external input section, an operation of the image forming apparatus according to the correspondence information table selected based on the user specifying information.

9. A computer-readable recording medium having stored thereon a program which controls an image forming apparatus to execute functions comprising:

forming a plurality of correspondence information tables, wherein each of the plurality of correspondence information tables specifies, for a corresponding user among a plurality of users, relationships between various function keys of a dedicated operation input section of the image forming apparatus and various keys of an external operation input section; and memorizing the plurality of correspondence information tables.

10. A computer-readable recording medium having stored thereon a program which controls an image forming apparatus and which includes a plurality of correspondence information tables, wherein each of the plurality of correspondence information tables specifies, for a corresponding user among a plurality of users, relationships between various function keys of a dedicated operation input section of the image forming apparatus and various keys of an external operation input section, and wherein the program controls the image forming apparatus to execute functions comprising:

when an operation input signal is inputted into the image forming apparatus from the various keys of the external operation input section, selecting one of the correspondence information tables based on a user switching signal from the external operation input section; and controlling an image forming operation of the image forming apparatus based on the relationships specified in the selected correspondence information table selected for the corresponding user.

* * * * *

UNITED STATES PATENT AND TRADEMARK OFFICE

CERTIFICATE OF CORRECTION

PATENT NO. : 7,657,201 B2
APPLICATION NO. : 11/453210
DATED : February 2, 2010
INVENTOR(S) : Tatsuyoshi Haga It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 801 days.

Signed and Sealed this

Thirtieth Day of November, 2010

David J. Kappos

David J. Kappos
*Director of the United States Patent and Trademark Office*